United States Patent [19]

Richter et al.

[11] 4,214,534

[45] Jul. 29, 1980

[54] COMMAND FUZING SYSTEM

[75] Inventors: Arnold A. Richter, Kensington; Charles E. H. Edwards, Bethesda, both of Md.

[73] Assignee: The United States of America as represented by the Secretary of the Army, Washington, D.C.

[21] Appl. No.: 839,797

[22] Filed: Jun. 30, 1969

[51] Int. Cl.[2] ..... F42C 11/06

[52] U.S. Cl. ..... 102/215; 89/6.5

[58] Field of Search ..... 89/41 B, 41 D, 41 EA, 89/41 AA, 41 SW, 6.5; 102/70.2, 215; 340/206; 343/7 PF, 17.1 PRF

[56] References Cited

U.S. PATENT DOCUMENTS

| | | | |
|---|---|---|---|
| 2,557,949 | 6/1952 | Deloraine | 102/70.2 RX |
| 2,703,399 | 3/1955 | Williams et al. | 102/70.2 RX |
| 2,709,773 | 5/1955 | Getting et al. | 343/7 A |
| 2,745,095 | 5/1956 | Stoddard | 102/70.2 P |
| 2,840,808 | 6/1958 | Woodward | 343/17.1 PRF |
| 3,048,087 | 8/1962 | Campbell | 89/41 D |
| 3,125,026 | 3/1964 | Johnson | 102/70.2 P |
| 3,225,695 | 12/1965 | Kapp et al. | 102/70.2 R |
| 3,417,700 | 12/1968 | Forlani | 102/70.2 R |
| 3,714,898 | 2/1973 | Ziemba | 102/215 |

*Primary Examiner*—Stephen C. Bentley

*Attorney, Agent, or Firm*—Nathan Edelberg; Robert P. Gibson; Saul Elbaum

[57] ABSTRACT

A command fuzing system for use in conjunction with small, rapid-fire projectiles. A narrow-beam radar transmitter, mounted on the weapon, transmits radar pulses along the trajectory of the projectiles. Each projectile contains a small horn antenna, a detector responsive to the radar pulses, an amplifier and a counter which is advanced with the receipt of each pulse. Upon receipt of a predetermined number of pulses, the counter triggers an SCR switch to cause detonation of the projectile in a well known manner. By adjusting the pulse rate of the radar transmitter the operator of the weapon can control the number of pulses reaching each projectile in a given time period, thereby controlling the point along the trajectory at which detonation occurs.

3 Claims, 6 Drawing Figures

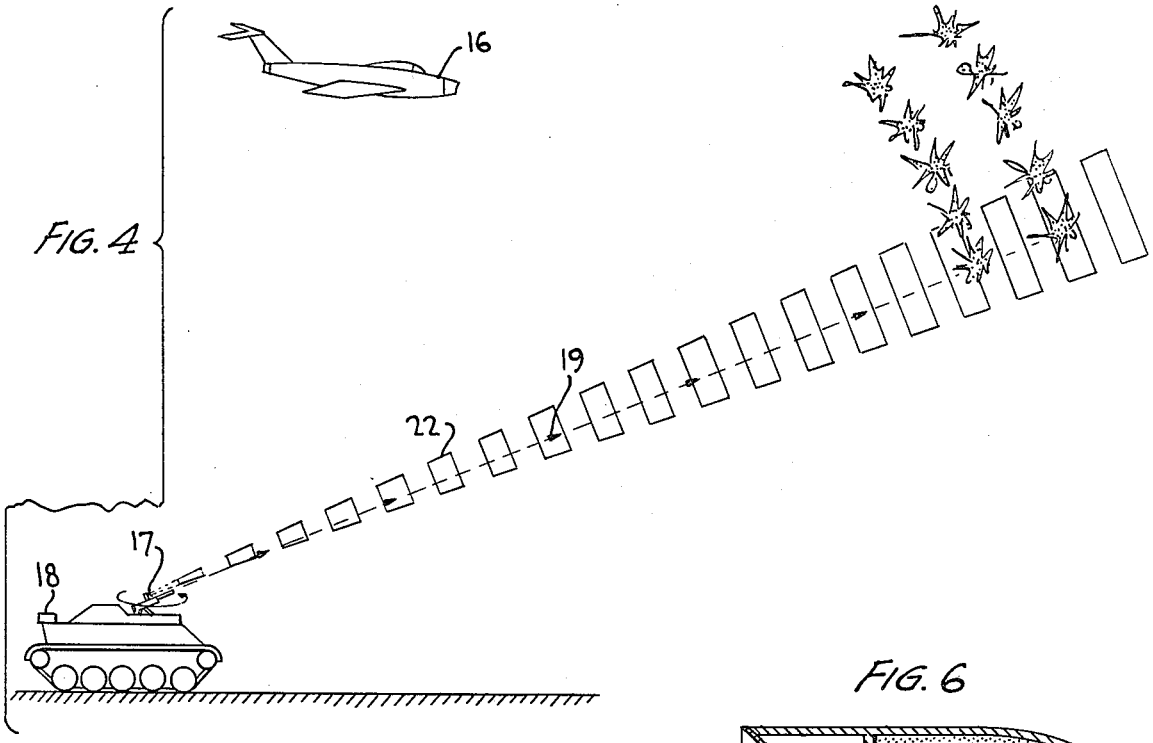
FIG. 4
FIG. 6
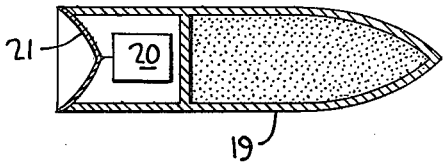
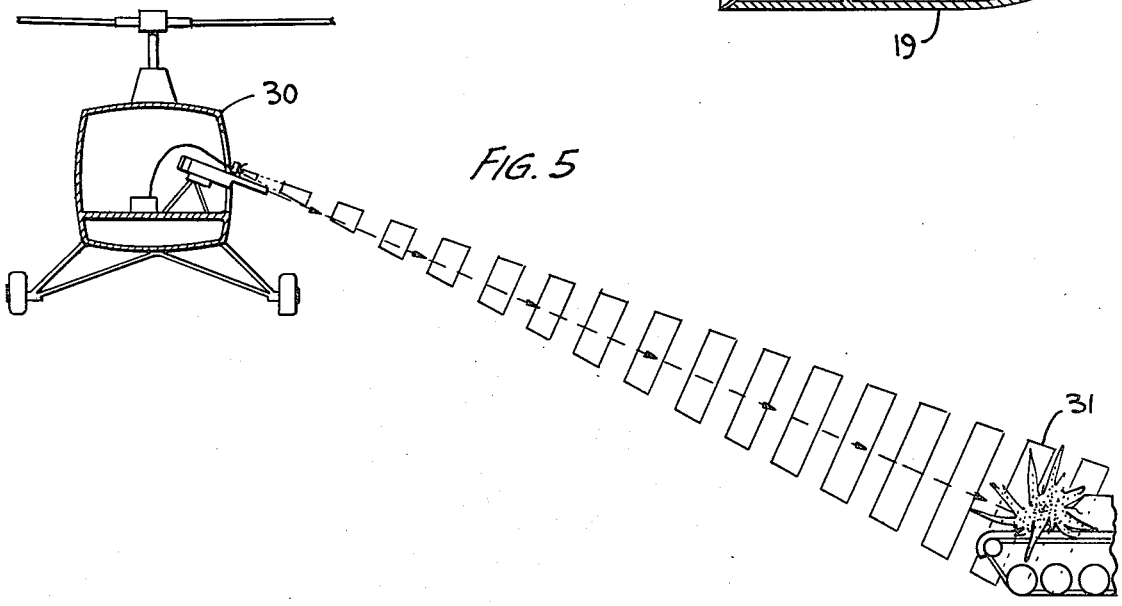
FIG. 5

COMMAND FUZING SYSTEM

RIGHTS OF GOVERNMENT

The invention described herein may be manufactured, used, and licensed by or for the United States Government for governmental purposes without the payment to us of any royalty thereon.

BACKGROUND OF THE INVENTION

This invention relates generally to command fuzing of projectiles, and specifically to a variable-time fuze system for small caliber rapid-fire projectiles.

There have been numerous attempts in the prior art to devise a system which will enable a projectile to be detonated at some predetermined point along its flight trajectory. One technique for accomplishing this purpose is to provide the projectile with a timed fuze set to go off at a predetermined time after firing. The disadvantage of this technique is that once the projectile has been fired all control over the time and place of detonation is lost. In other systems the point of detonation of the projectile can be subject to control by a ground operator, but in these systems it has been found necessary to rely upon a proximity detector which is responsive to the target or ground signature for its operation. Such systems are exceedingly complex and would not lend themselves readily to adoption in a small caliber, rapid-fire projectile system as contemplated by this invention.

It is therefore a primary object of this invention to provide a command fuzing system for small caliber, rapid-fire projectiles in which the point of detonation is controlled by an operator.

It is another object of this invention to provide a command fuzing system which does not depend upon proximity detectors.

Still another object of this invention is to provide a command fuzing system which is simple, rugged, reliable, and capable of being implemented in small size projectiles.

These and other objects of the invention will become more apparent from the detailed description of the preferred embodiments.

SUMMARY OF THE INVENTION

Briefly, in accordance with this invention, a narrow-beam radar transmitter is mounted on a weapon so as to transmit pulses along the trajectory of the projectile. Each projectile is fitted with a radar detection system and a counter capable of producing an output pulse after receipt of a predetermined number of pulses. An SCR switch responsive to the output pulse of the counter causes detonation of the projectile in a well known manner. By adjusting the pulse rate of the radar transmitter the operator of the weapon is able to control the number of pulses reaching each projectile in a given time period and control the point along the trajectory at which detonation occurs.

BRIEF DESCRIPTION OF THE DRAWINGS

The specific nature of the invention as well as other objects, aspects, uses, and advantages thereof will clearly appear from the following description and from the accompanying drawing, in which:

FIG. 4 is a pictorial view of one embodiment of the invention.

FIG. 5 is a pictorial view of a second embodiment of the invention.

FIG. 6 is a cross-sectional view of a projectile modified for use with the invention.

DESCRIPTION OF THE PREFERRED EMBODIMENTS

Figure 1:
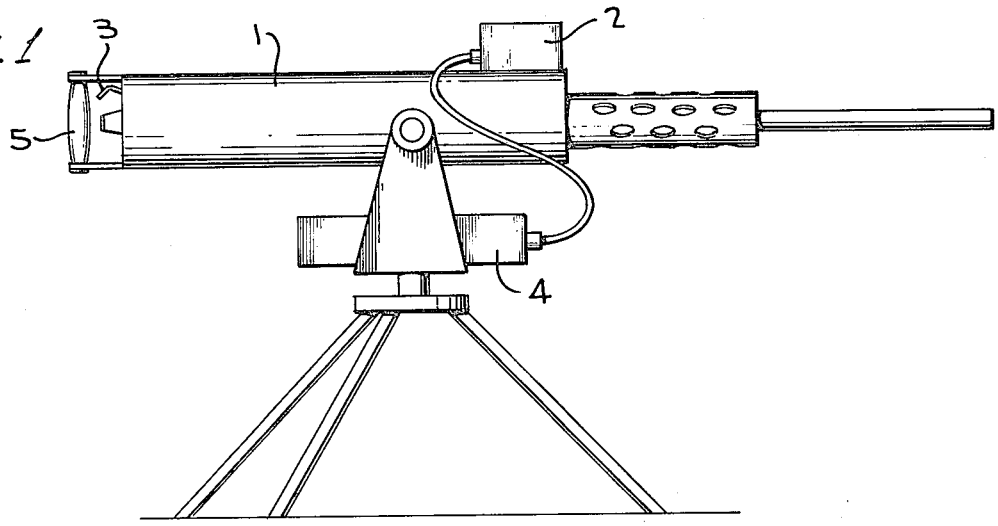
FIG. 1 is a perspective view of a rapid fire machine gun and associated radar illuminator in accordance with one embodiment of this invention.

FIG. 1 illustrates the transmitter portion of the invention as applied to a rapid-fire machine gun. The machine gun is modified by the addition of a radar pulse transmitter which is mounted coaxilly with the gun so that the radar beam includes the trajectory of the projectile. Upon activation of trigger 3 radar transmitter 2 will transmit radar pulses simultaneously with the firing of projectiles from the machine gun. The pulse repetition rate of the radar transmitter can be varied at will by the operator by adjusting the position of bar handle 5. Power supply 4 is conveniently mounted on or adjacent to the machine gun to provide power for radar transmitter 2.

Figure 2:
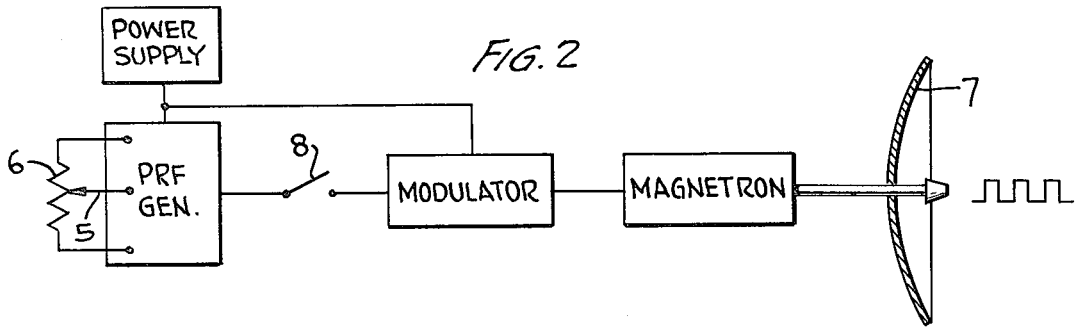
FIGS. 2 and 3 are block diagrams of the transmitter and receiver portions which may be used in conjunction with this invention.
Figure 3:
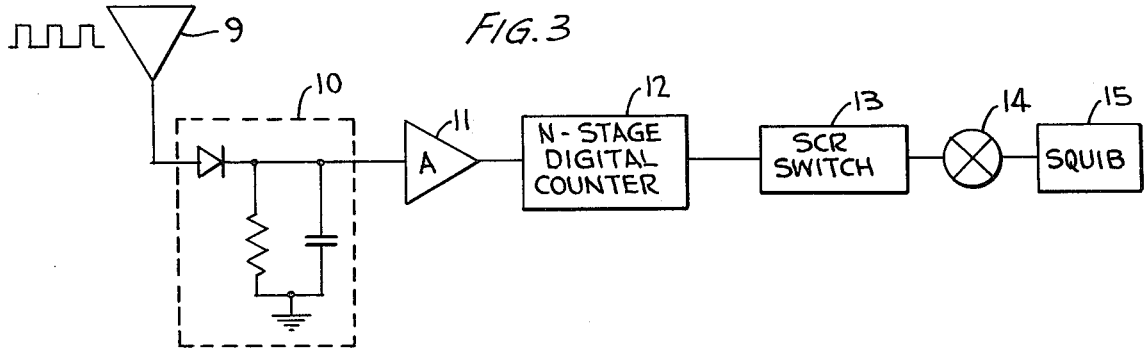

FIG. 2 illustrates a block diagram of the radar transmitter of FIG. 1. The radar transmitter consist basically of a PRF generator connected to a modulator and magnetron for feeding pulses to radar antenna 7. The modulator operates as a trigger to activate the magnetron to full power. Switch 8 in FIG. 2 is the switch which is activated when the operator activates trigger 3 as illustrated in FIG. 1. Resistor 6 in FIG. 2 is the variable resistor which is adjusted by the movement of bar handle 5 in FIG. 1. Thus in the operation of the transmitter, power supply 4 is constantly on and feeds the PRF generator. When the operator sights an enemy target, activation of machine gun trigger 3 closes switch 8 which enables pulses to reach radar antenna 7. Adjusting bar handle 5 varies resistor 6 which controls the frequency of pulses produced by the PRF generator and transmitted to antenna 7. A receiver capable of responding to radar pulses is located in each of the projectiles fired from the machine gun. As illustrated in FIG. 3, antenna 9 receives pulses and applies them to a video detector 10. This may be a common video detector having the usual series rectifier and parallel RC circuit. The pulses are amplified in video amplifier 11 and applied to a counter 12. The counter will be more fully described later. It suffices at this point to say that each of the RF pulses advances the counter one count, until the capacity of the counter is reached, at which point an output pulse will be produced to actuate SCR switch 13 and produce an electrical signal to operate the squib 15. While the projectile is heading toward the target, RF energy is continuously detected and applied to the counter. Also during flight, or upon firing, mechanical safety-and-arming mechanism 14 will arm in a manner well known in the art. As each projectile reaches the point along the trajectory at which a predetermined number of pulses have been applied to digital counter 12, the projectile will explode.

The operation of the system can best be understood with respect to FIG. 4 which shows an enemy aircraft 16 approaching the range of a rapid-fire machine gun 17 located on a ground tank 18. Upon actuation of the trigger of machine gun 17, rapid-fire projectiles 19 are sequentially fired. Each of the projectiles 19 is modified by the addition of a radar detector shown generally at 20 and illustrated in FIG. 6. Cone antenna 21 is preferably located at the rear of the projectile, although it may also be located elsewhere. Because projectile 19 is arranged to explode upon receipt of a predetermined number of radar pulses, the position along the trajectory at which the explosion will occur will of course depend upon the distance the projectile has travelled at the time the required number of pulses have been received. Thus the explosion point can be selected by the operator at will simply by varying the pulse repetition rate of the radar transmitter. As the repetition rate is increased the predetermined number of pulses will arrive at projectile 19 in a shorter time period and the projectile will, therefore, explode sooner. Conversely, if the pulse repetition rate is decreased, a longer time period will elapse before the required number of pulses have reached the projectile. Accordingly, the projectile will travel a greater distance before exploding. As the operator notes the location of the first explosion, he adjusts the handle on the machine gun to vary the pulse rate of the radar transmitter and to thereby change the position at which the projectile explodes. One obvious advantage of this invention is that the explosion point may be varied simultaneously with the firing of the machine gun. This enable continuous fire without interruption or loss of valuable time.

FIG. 5 shows how the invention may be utilized in an air-to-ground weapon system. In this system the weapon is located in a helicopter 30 and used against personnel or armored vehicles located on the ground. A particularly advantageous feature of this arrangement is that by properly adjusting the pulse repetition rate of the radar transmitter, the projectiles, may be used to penetrate an armored vehicle 31, or if desired, the projectiles may be caused to air burst around the armored tank so as to be an effective weapon against enemy personnel who may be located near or hiding behind the armored vehicle. Thus this single weapon can be switched from an air-burst mode to an armor-penetrating mode instantaneously and without interruption of firing.

The invention may be modified by a control system for automatically determining the required pulse repetition frequency for any given target. Helicopter 30, for example, may be provided with a target location-and-tracking radar for determining the range of the target as well as the ground-to-air elevation of the helicopter. The projectile burst point would be automatically computed by information gathered from instruments, and this computation would be applied to the radar transmitter. Such a computer and control system may of course also be utilized in conjunction with a weapon which is located on the ground; however, in order to achieve greater mobility and versatility of the weapon it is contemplated that the point of air burst will usually be determined by the operator.

While many variations are possible, it is contemplated that the invention may be best utilized in conjunction with 30 or 40 milimeter projectiles.

Any suitable transmitter may be utilized. It is contemplated that a transmitter operating between 30 to 140 GHz and having a pulse repetition rate which is variable from 5 KHz to 30 KHz would be satisfactory. This frequency range permits the use of a small transmitting aperture, approximately 2 to 4 inches in diameter, with high gain of about 20 to 30 dB and directivity. The entire illuminator can be packaged in a lightweight small size package which easily and unobtrusively mounts on existing weapons. This frequency would also permit the use of a small, medium gain about 10 dB, horn antenna on the projectile. The use of restricted beamwidths at the transmitter and receiver systems would offer substantial immunity to unwanted signals causing malfunctions of the projectile. An RF transmitter capable of producing a narrow, high-powered beam is commercially available and could readily be utilized in this invention.

The counter may typically by a ten stage binary counter which triggers a SCR when a count of 1,024 pulses is received. The detector may typically be an integrated circuit detector. Assuming a 2,500 ft. per second velocity of a 30 millimeter projectile, it will be seen that for a range of 500 feet to 10,000 feet the flight time would be in the order of 1/5 of a second to 4 seconds. This would require a variation in pulse repetition frequency of between 5,120 pulses per second and 256 pulses per second. Magnetron-modulator BL 243 C, having a 50 nsec pulse width and a frequency of 20 KC per second would be sufficient for this purpose. These examples are, of course, merely exemplary as other modifications can be made within the skill of the ordinary worker in the art.

It is contemplated in this invention that the bar handle would control air-burst of the projectile only within its last 500 feet of travel. This would eliminate the danger of air-burst too close to the operator and would also provide the system with greater accuracy and efficiency over the range which is subject to control. Of course the range subject to manual control may be made larger or smaller as desired.

In order to aid the operator in determining the desired position of air-burst, each projectile may be provided with a colored smoke marker or other means to produce bright flashes of light during air-burst. By observing the position of initial air-burst, the operator would be able to adjust the bar handles in order to position the air-burst at the desired location.

With micro-electronic technology now available in the art, small projectiles may be economically provided with the detection and counting systems necessary for the operation of this invention. It is contemplated that the detection portion of this invention would utilize integrated circuit technology particularly for the video detector, video amplifier, counter and firing circuit. The techniques of integrated circuitry are well known and would permit the fabrication of the receiver on a single small substrate which would be compatible with space available in small projectiles. The low power requirement of integrated circuits would permit the use of a small, low cost battery on each projectile, or the system may be used without a battery by employing RF power to store energy in a capacitor. Other power generators may also be employed.

While particular embodiments have been shown and described, it will be appreciated that these are only exemplary and that various modifications of construction and design are contemplated within the scope of the invention. We therefore wish it to be understood that we do not desire to be limited to the exact details of construction shown and described, for obvious modification will occur to a person skilled in the art.

We claim:

1. A command fuzing system comprising:

(a) A weapon capable of firing projectiles:

(b) a pulse radar transmitter having a variable pulse rate and located adjacent said weapon for transmitting pulses along the trajectory of said projectiles;

(c) projectiles capable of being fired from said weapon;

(d) means in said projectiles to count each of said pulses and to cause detonation upon receipt of a predetermined number of said pulses; and (e) a bar handle located on said weapon for adjusting the pulse repetition frequency of said radar transmitter in order to change the point along the trajectory at which detonation occurs.

2. The system of claim 1 further comprising a switch on said weapon for simultaneously activating said weapon and radar transmitter.

3. A weapon system comprising:

an R.F. pulse transmitter having a transmitting antenna for transmitting pulses;

a projectile having a fuze; said fuze including a receiving antenna disposed within a central core of the aft end of said projectile and having a maximum gain to the rear of said projectile for receiving pulses transmitted from said transmitter;

an R.F. detector having an input terminal coupled to said receiving antenna and an output terminal;

a fixed-set counter having an input terminal coupled to said detector output terminal for accommodating pulses therefrom and an output terminal for presenting a full-count signal when a preset count of pulses has been accumulated;

a firing circuit having an input terminal coupled to said counter output terminal for detonating said fuze when said full-count signal is presented by said counter;

variable pulse rate control means coupled to said transmitter for varying the pulse rate of said transmitter;

a gun for discharging said projectile at a target; and a target ranging means for determining the range of the target from said gun, and coupled to said pulse rate control means for causing said pulse rate control means to vary the pulse rate of said transmitter in inverse proportion to the range of the target from said gun.

* * * * *